US005484071A

United States Patent [19]

Zumbuhl

[11] Patent Number: 5,484,071

[45] Date of Patent: Jan. 16, 1996

[54] TAMPER INDICATING RING CONSTRUCTION FOR CLOSURES

[76] Inventor: Bruno Zumbuhl, 2760 Sugar Cane La., Evansville, Ind. 47715

[21] Appl. No.: 247,632

[22] Filed: May 23, 1994

[51] Int. Cl.[6] ..... B65D 41/34

[52] U.S. Cl. ..... 215/254; 215/256

[58] Field of Search ..... 215/252, 254, 215/256, 341, 343, 344, 349, 350, 351; 220/304

[56] References Cited

U.S. PATENT DOCUMENTS

| | | | |
|---|---|---|---|
| 4,346,811 | 8/1982 | Hilaire | 215/252 |
| 4,579,241 | 4/1986 | Hayes | 215/252 |
| 4,744,479 | 5/1988 | Schottli | 215/252 |
| 4,828,127 | 5/1989 | Young et al. | 215/252 |
| 5,179,621 | 3/1993 | Bartl et al. | 215/331 |

*Primary Examiner*—Stephen J. Castellano

*Attorney, Agent, or Firm*—Charles E. Temko

[57] ABSTRACT

An improved tamper-indicating ring construction for threaded closures in which the closure and tamper indicating ring are provided with mating camming surfaces which are brought into contact when the closure is unthreaded from a container finish. The angle of the camming surfaces with respect to principal axis of the closure is substantially greater than the lead on the threads of the closure, so that when the closure is rotated to open the container, the camming surfaces push the tamper indicating ring downwardly to break the interconnecting bridges which link the ring and the upper part of the closure. The bridge members are positioned upon the camming surfaces and are oriented almost transversely to said principal axis, so as to be broken by shear rather than tensional stresses, this permitting the use of relatively stronger bridge members with the assurance that they will be broken with relatively little effort on the part of the user. In one embodiment, means is provided for splitting the ring upon removal of the closure so that it remains interconnected to the closure rather than the container finish.

3 Claims, 3 Drawing Sheets

TAMPER INDICATING RING CONSTRUCTION FOR CLOSURES

BACKGROUND OF THE INVENTION

This invention relates generally to the field of threaded closures for container necks or finishes, and more particularly to an improved construction incorporating improved tamper indicating ring means actuated when the closure is first removed from the container neck. Devices of this general type are known in the art, and the invention lies in specific constructional details which permit improved ease of operation on the part of the user, and the use of frangible members which are less prone to accidental breakage.

In the conventional prior art construction, it is usual to provide a screw type or threaded closure element with a depending tamper indicating ring, the ring being frangibly interconnected by a plurality of axially aligned bridge members attached to the lower edge of the closure element. When the closure element is unthreaded, the bridge members are disconnected, allowing the closure element to be removed leaving the ring element engaged with a corresponding retaining bead on the container finish.

This construction is not without utility, and, indeed, it has been widely used. However, in order that the user be able to unthread the closure without difficulty, the frangible interconnection between the bridge members and the lower edge of the closure element must be relatively weak, and often, they fracture when the closure is installed, rather than when it is removed. Equally often, the bridge members are damaged by mere careless or clumsy handling of the container.

SUMMARY OF THE INVENTION

Briefly stated, the invention contemplates provision of an improved closure construction having a tamper indicating ring in which the above mentioned disadvantages have been substantially eliminated. To this end, the lower edge of the closure element and the upper edge of the tamper indicating ring element are provided with mating camming surfaces which are brought into contact as the user unthreads the closure element. The bridging links are relatively short, and are positioned between the pairs of camming surfaces to have a peripheral axis disposed at a substantial angle relative to the principal axis of the closure. During removal of the closure element, the links are subjected to a shearing stress rather than a tensional stress prior to being severed. This enables the use of bridging links which are considerably less frangible than is the case in the prior art, with less susceptibility to accidental damage, without increasing the manually applied force required on the part of the user.

In an alternate embodiment, this novel structure is incorporated into a ring element which is adapted to split upon removal of the closure element and thus remain attached to the closure element rather than attached to the container neck.

BRIEF DESCRIPTION OF THE DRAWINGS

In the drawings, to which reference will be made in the specification, similar reference characters have been employed to designate corresponding parts throughout the several views.

DETAILED DESCRIPTION OF THE DISCLOSED EMBODIMENT

Figure 1:
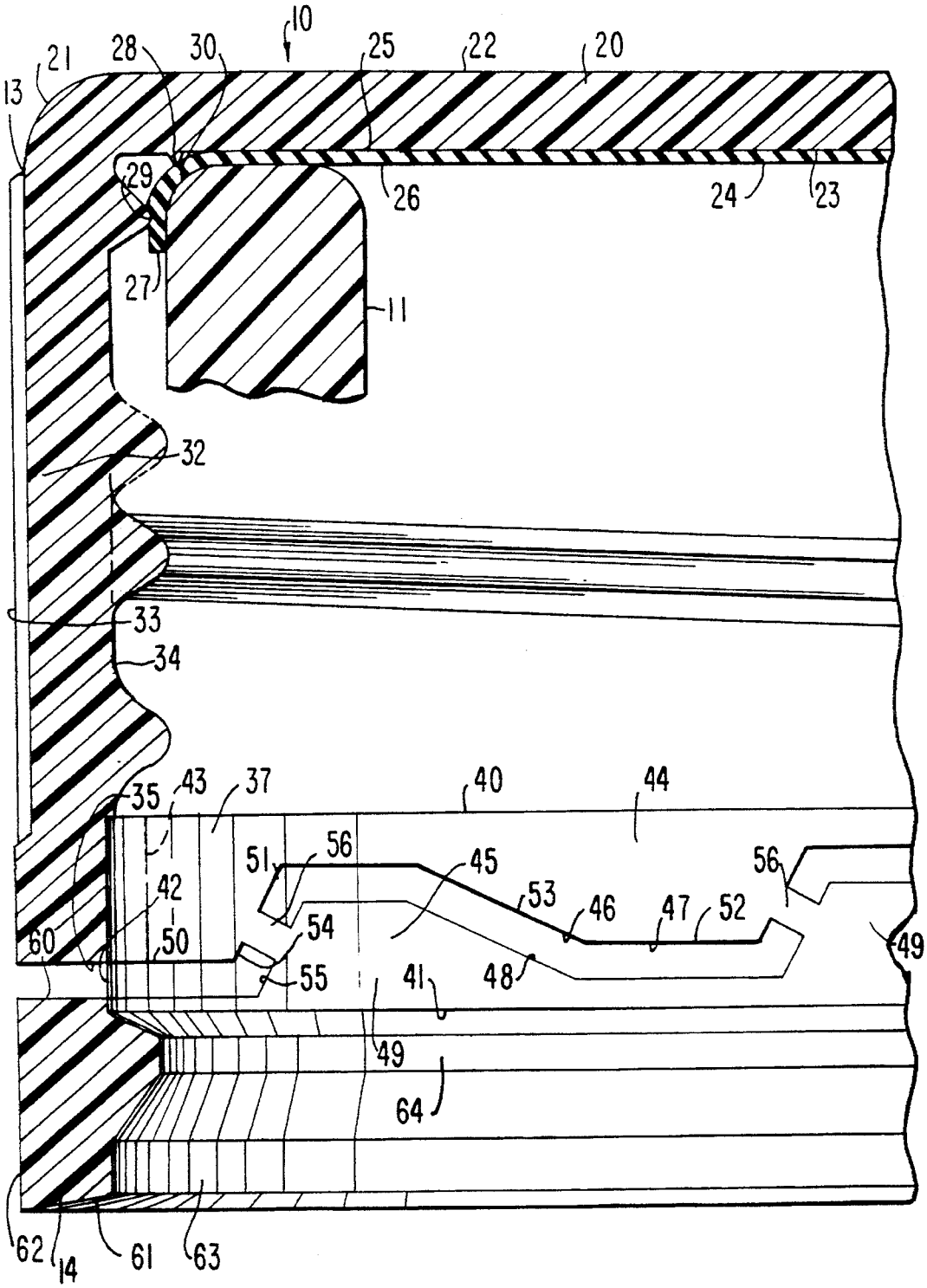
FIG. 1 is a fragmentary schematic partial sectional view of a first embodiment of the invention.
Figure 2:
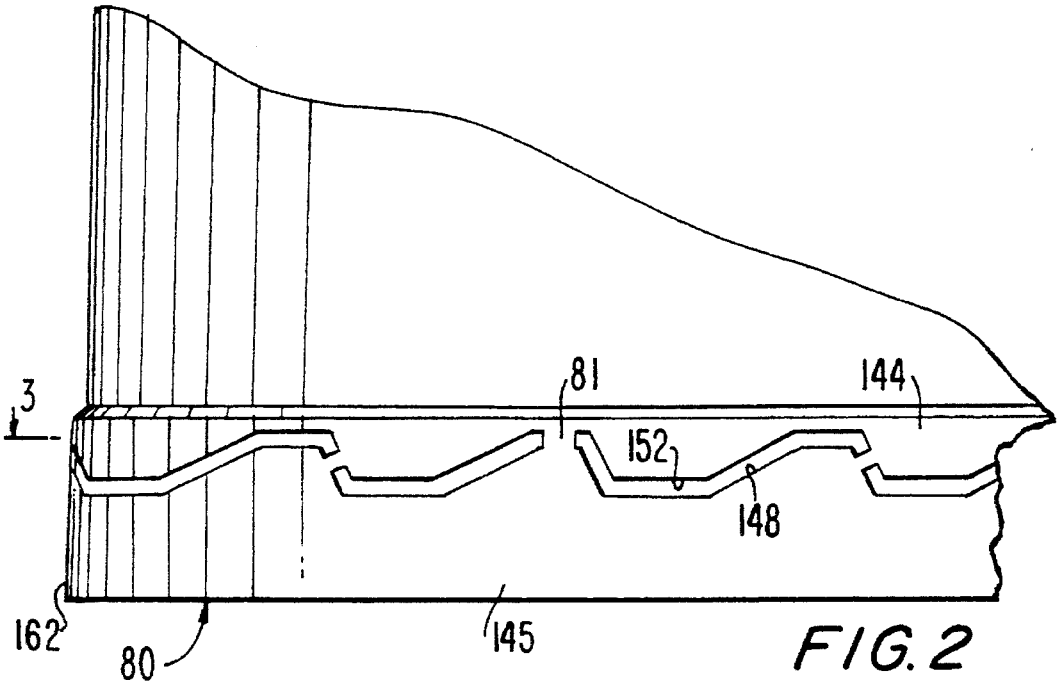
FIG. 2 is a fragmentary schematic view of a second embodiment of the invention.

In accordance with the first embodiment of the invention, the device, generally indicated by reference character 10 is preferably of integrally molded synthetic resinous construction, and is adapted to be threadedly engaged upon the end 11 of a container finish defining an opening. The device includes a closure element 13 and a tamper indicating ring element 14 frangibly interconnected therewith (FIG. 1).

The closure element 13 is of generally conventional construction, and includes an end wall 20 bounded by a rounded peripheral edge 21 and having an outer surface 22 and an inner surface 23. Positioned upon the inner surface 23 is an optional planar gasket or liner 24 having first and second planar surfaces 25 and 26 bounded by a peripheral edge 27. First and second relatively sharp annular ribs 28 and 29 are located in the area of the edge 21 and cooperate with a peripheral edge 30 of the container finish 11 so that when the closure element is tightened thereupon, the peripheral edge of the gasket 24 will be pinched therebetween to form an unusually effective seal.

Extending longitudinally of the end wall 20 is a cylindrical wall 32 having a knurled outer surface 33 and an inner threaded surface 34 terminating in a lower annular edge 35.

Figure 4:
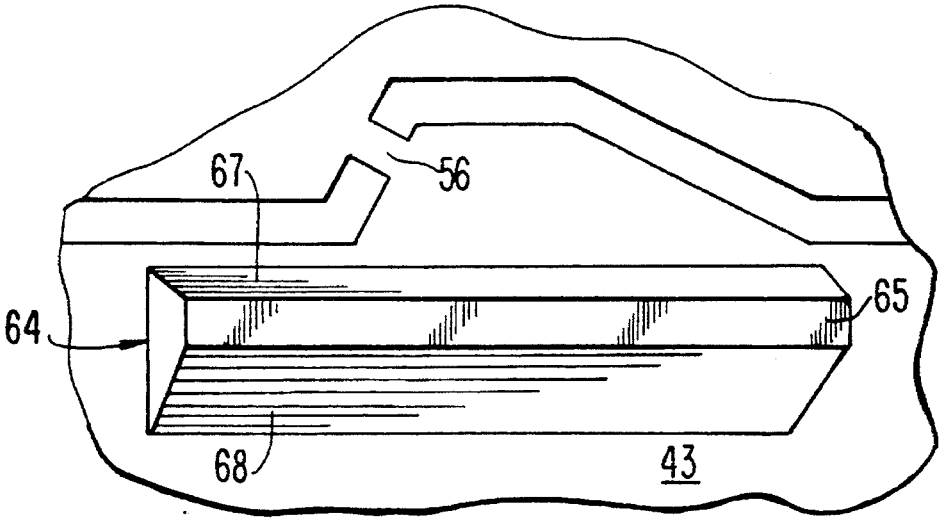
FIG. 4 is a fragmentary schematic view showing a ring retaining bead employable with either the first or second embodiment.

Depending from the area of the edge 35 is an annular bridge element 37 integrally formed with elements 13 and 14 and bounded by an upper surface 40, a lower surface 41, an outer peripheral surface 42 and an inner peripheral surface 43 (see FIG. 4). Upper and lower members 44 and 45, respectively, define a continuous annular slot 46 bounded by an upper edge 47 and a lower edge 48. Each of the edges 47–48 forms plural segments 49 in repetitive fashion, each segment including a first laterally extending portion 50, a first angularly disposed portion 51, a second laterally extending portion 52 and a second angularly disposed or sloping portion 53. The edges defining the first angularly disposed portion 51 form first and second camming surfaces 54 and 55 interconnected by a frangible link 56.

Figure 5:
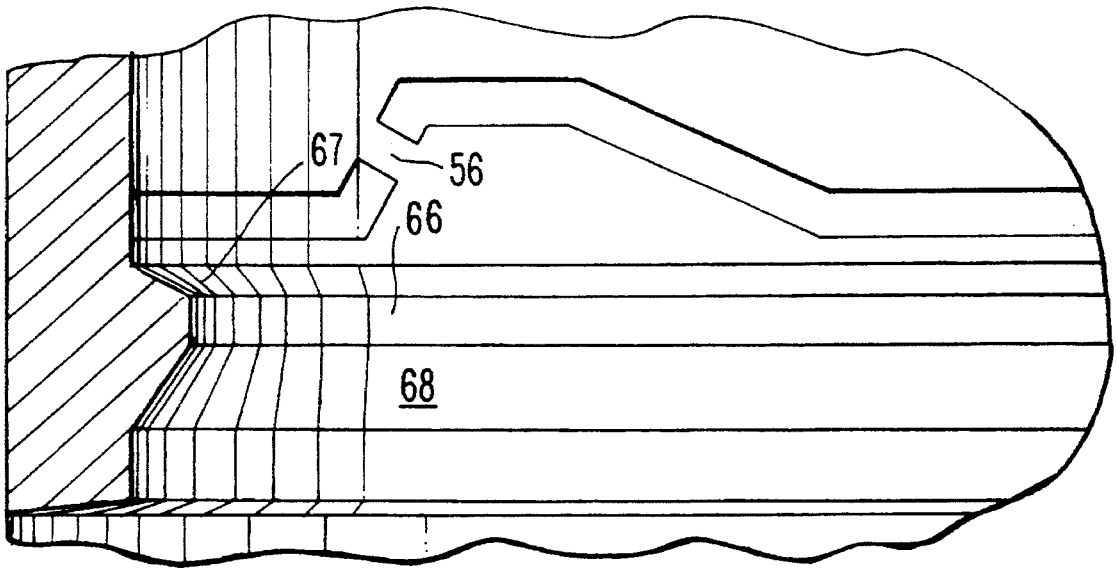
FIG. 5 is a fragmentary sectional view showing another form of ring element retaining bead suitable for use with either the first or second embodiment.

The tamper indicating ring element 14 is generally conventional, and is bounded by an upper surface 60, a lower chamfered surface 61, an outer surface 62 and an inner surface 63 having an inwardly facing retaining bead 64. As best seen in FIGS. 4 and 5, the bead 64 may be in the form of segments 65, or as a continuous projection 66, each having tapered lower and upper surfaces 67 and 68 to enable the same to pass over and be retained by a retaining bead (not shown) on the container neck.

Installation of the device 10 is generally conventional, and occurs by either threading the cap into position upon the container neck, or by axially pushing the same relying upon the natural resiliency of the synthetic resinous materials to enable seating of the closure upon the container neck without damage. When the closure is threaded upon the container neck, the sloping portion 54 of each segment 49 tend to contact each other thereby protecting the frangible links 56. When the closure is unthreaded to gain access to the contents of the container, because of frictional resistance between the ring element 14 and the container neck, the camming surfaces 54 and 55 will be pressed against each other, wherein the camming action will simultaneously exert a shearing stress upon each of the interconnected frangible links 56, and also serve to push downwardly upon the ring element 14 relative to the closure element 13. Very little rotation is required to effect severing of the links 56, owing to the mechanical advantage gained by the engagement of the camming surfaces. Once severed, the closure element can be unthreaded with relative ease.

Figure 3:
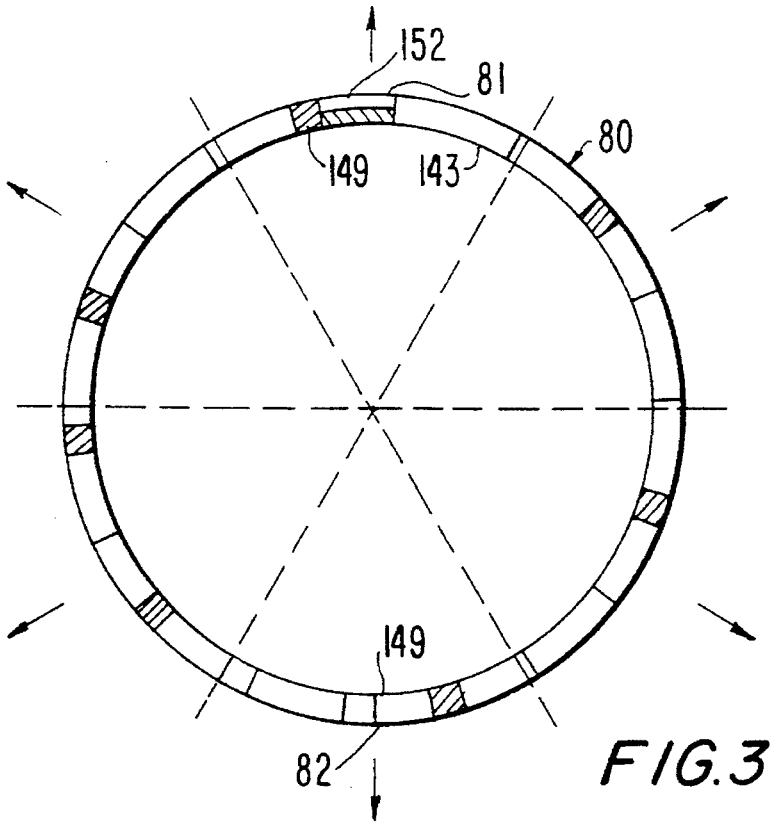
FIG. 3 is a schematic sectional view as seen from the plane 3—3 in FIG. 2.

Turning now to the second embodiment of the invention (FIG. 3), generally indicated by reference character 80, parts corresponding to those of the first embodiment have been designated by similar reference characters with the additional prefix "1", thereby avoiding needless repetition.

The second embodiment differs from the first embodiment in the provision of a relatively larger bridge link 81 which is relatively non-frangible and which interconnects portions of the second lateral portion 52 on one of the segments 49. An opposite segment 49 positioned approximately 180 degrees therefrom is provided with an area 82 which is substantially weakened, or completely severed, so that when the closure element is unthreaded, the ring element will split and remain attached to the closure element through the non-frangible link 81.

It will be observed that the axial length of the frangible links, as compared with conventional bridge members is relatively short, and the cross sectional area of interconnection may be substantially larger. While this might otherwise entail increased effort on the part of the user when unthreading the closure, because of the presence of angularly disposed camming surfaces, the forces exerted on the links are in the nature of a shear rather than tension, and, given the mechanical advantage obtained by using the camming surfaces, no more than normal torque is required on the part of the user in unthreading the closure.

I wish it to be understood that I do not consider the invention to be limited to the precise details of structure shown and set forth in the specification, for obvious modifications will occur to those skilled in the art to which the invention pertains.

I claim:

1. In a threaded closure for containers having a correspondingly threaded container finish including an upper closure element and frangibly interconnected tamper indicating ring element, the improvement comprising: a bridge element of generally cylindrical configuration having an upper member integrally formed with said closure element, and a lower member integrally formed with said ring element; said upper member having a substantially continuous lower edge forming plural camming surfaces; said lower member having a substantially continuous upper edge forming mating camming surfaces; plural frangible links interconnecting said mating camming surfaces; said mating camming surfaces being brought into operative contact during the unthreading of said closure element from said container finish to result in imparting a shearing stress upon said frangible links and serving to sever said links as said closure element is removed.

2. The improvement in accordance with claim 1, in which said ring element has an additional enlarged relatively non-frangible link interconnecting said upper and lower members of said bridge element, there being a weakened area on said ring element positioned approximately 180° apart from said additional link which ruptures upon removal of said closure element to allow said ring element to remain attached to said closure element.

3. The improvement in accordance with claim 1 in which said ring element has an additional enlarged relatively non-frangible link interconnecting said upper and lower members of said bridge element, there being a severed area on said ring element positioned approximately 180° from said additional link which spreads upon removal of said closure element to allow said ring element to remain attached to said closure element.

* * * * *